US005159716A

United States Patent [19]

Takata

[11] Patent Number: 5,159,716

[45] Date of Patent: Nov. 3, 1992

[54] SURFACE SUIT WITH REMOVABLE WATER AND WIND RESISTANT INSERTS

[76] Inventor: Allan Takata, 4435 L. Honoapiilani, #118, Lahaina, Hi. 96761

[21] Appl. No.: 725,515

[22] Filed: Jul. 3, 1991

[51] Int. Cl.[5] ..... A41D 13/00

[52] U.S. Cl. ..... 2/2.1 R; 2/69; 2/70; 2/79; 2/247

[58] Field of Search ..... 2/2.1 R, 69, 69.5, 70, 2/79, 258, DIG. 5, 82, 247

[56] References Cited

U.S. PATENT DOCUMENTS

| | | | |
|---|---|---|---|
| 2,383,261 | 8/1945 | Kronhaus | 2/82 |
| 3,803,652 | 4/1974 | Uyehara | 9/310 |
| 4,195,362 | 4/1980 | Rolando | 2/2 |
| 4,293,957 | 10/1981 | Melarvie | 2/2.1 R |
| 4,294,242 | 10/1981 | Cowans | 2/2.1 R |
| 4,397,636 | 9/1983 | Granshaw | 441/65 |
| 4,494,246 | 1/1985 | Tillbrook et al. | 2/2.1 R |
| 4,507,801 | 4/1985 | Kavanagh et al. | 2/2 |
| 4,688,269 | 8/1987 | Maeshima | 2/2 |
| 4,710,978 | 12/1987 | Pankopf | 2/2.1 |
| 4,722,710 | 2/1988 | Hagen et al. | 2/2.1 R |
| 4,741,050 | 5/1988 | O'Kane et al. | 2/2.1 R |
| 5,022,878 | 6/1991 | Casad | 2/2.1 R |
| 5,052,052 | 10/1991 | Gilford et al. | 2/69 |

*Primary Examiner*—Werner H. Schroeder
*Assistant Examiner*—Gloria Hale
*Attorney, Agent, or Firm*—Marvin S. Townsend

[57] ABSTRACT

An improved garment is provided for a wearer. The garment includes a plurality of flexible, non-airtight garment modules having pockets. A plurality of flexible, water-resistant inserts are provided that are capable of being placed in and removed from the pockets. Preferably, the pockets of the garment modules and the water-resistant inserts for the pockets cover nearly the entire garment module. Because the pockets and the pocket inserts extend up to the edge regions, the edge regions serve, in effect, as flexible joints between adjacent pockets with their respective inserts.

11 Claims, 3 Drawing Sheets

SURFACE SUIT WITH REMOVABLE WATER AND WIND RESISTANT INSERTS

FIELD OF THE INVENTION

The present invention relates to the field of garments, especially garments worn by persons engaged in activities on the surface of water such as board sailing, surfing, conventional sailing, water skiing, kayaking, and the like.

BACKGROUND OF THE INVENTION

Presently, there are garments known as wetsuits that are specifically designed for use under water. A typical wet suit is designed to trap water inside the suit which is heated by the wearer's body temperature to keep the wearer comfortable in the usually cold environment that exists under water.

Such a wet suit may be fine for under water activities. However, for activities on the surface of water, a wetsuit presents a number of problems. For example, when a wearer of a wetsuit is on the surface of the water, an undesirably excessive amount of heat can build up within the wetsuit.

A wetsuit is relatively heavy when wet and holding water. Under water its weight is somewhat compensated for by the buoyancy of the water. However, on the surface of the water, the weight of the wetsuit, without being aided by the water buoyancy, can become excessive and fatiguing.

On the surface of the water, the wetsuit, in being made from a continuous waterproof material such as neoprene rubber, has relatively impeded flexibility at bendable areas of the wearer such as the arms and legs. As such, wearing the wetsuit on the surface of the water when engaged in activities which require a large amount of arm and leg activity can be very fatiguing.

With a conventional wetsuit, since it is designed to hold water, it is very difficult to remove water once it enters the suit. With water activities on the surface of the water, water that is retained inside the wetsuit can be very annoying and discomforting. Also, retained water adds considerably to the weight of the suit, and the increased weight causes additional fatigue and impedes the wearer's activity.

A conventional wetsuit has predetermined weight and thickness. Thus, the wearer of a conventional wetsuit cannot compensate for variations in sunshine, wind speed, temperature, and other weather factors.

SUMMARY OF THE INVENTION

Accordingly, it is an object of the present invention is to provide a suit to be worn on the surface of water that precludes an undesirably excessive amount of heat build up within the surface suit.

Another object of the present invention is to provide a suit to be worn on the surface of water that is relatively light weight and is less fatiguing to wear than a conventional wetsuit.

Still another object of the present invention is to provide a suit to be worn on the surface of water that has greater flexibility and is less fatiguing to wear and use on the surface of the water than a conventional wetsuit.

Yet another object of the present invention is to provide a suit to be worn on the surface of water that permits water, that enters the suit, to drain out from the suit, thereby permitting the wearer to carry less dead weight and permitting enhanced performance in a chosen activity.

Another object of the present invention is to provide a suit to be worn on the surface of water whose weight, water-repelling, and wind-breaking characteristics can be adjusted to compensate for variations in sunshine, wind speed, temperature, and other weather factors.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved garment is provided for a wearer. More specifically, the invention includes a garment system which includes a set of a plurality of flexible, non-airtight garment modules which a portion of include an outer shell and separable flaps. The separable flaps of a module provide a lining for the module. A portion of the outer shell for a module and the lining provided by the separable flaps for the module, together define a pocket for the module. A set of flexible, water-resistant or repellent inserts is provided which are capable of being placed in or removed from the pockets by simply separating the flaps. The size and shape of the insert determines the size and shape of the pocket formed by the portion of the outer shell of the garment and the separable flaps of the lining. Means are provided for attaching the set of inserts to the garment modules within the respective pockets. Such attaching means include complementary barb and loop fasters such as VELCRO brand fasteners. More specifically, complementary barb and loop fasteners are present on the respective inserts and the respective outer shells. In addition, complementary barb and loop fasteners will be present on the respective separable flaps and the inserts.

The pockets of the modules and the water-resistant or repellent inserts for the pockets cover nearly the entire garment module. Moreover, the garment modules are substantially coextensive with the entire garment. In this respect, the pockets and the pocket inserts extend up to the edge regions of the modules. Because the pockets and the pocket inserts extend up to the edge regions of the modules, the edge regions serve, in effect, as flexible joints between adjacent pockets with their respective inserts.

In the preferred embodiments, the garment of the invention is worn by a wearer for use in an activity on the surface of water. Preferably, the garment modules have an outer shell and an inner lining, made from separable flaps. Both the outer shell and the inner lining can be made from an elastic material such as Lycra fabric.

The pocket inserts can be of a variety of thicknesses for a variety of purposes. For example, for a hot, relatively windless day, the inserts could be thin and lightweight. On the other hand, for a cold, windy day, the inserts could be relatively thick.

Alternatively, the garment modules can be worn without the inserts on very warm days or when the user returns to the beach.

The garment modules can be worn covering substantially the entire body like a ballet outfit. Also, various garments of the invention can be used independently depending on the amount of protection needed.

The pocket inserts may be secured in place within the garment module to its outer shell and inner lining by any conventional means such as complementary barb and loop fasteners such as a VELCRO-like material, as mentioned above, or by simple snaps.

The garments of the invention can be combined to provide a wide range of body protection, from minimal chest area protection to full body protection. The set of garments of the invention is comprised of the following garments: a sleeveless vest (for men or women); a short sleeved shirt (for men); a short john (for men or women); a long john (for men or women); a spring suit (for men or women); a full suit (for men or women); a bikini bottom (for women); a short sleeved top (for women); a long sleeved top (for women); a maillot (for women); short tights (for women); and long tights (for women).

Depending on the amount of protection needed, the wearer may choose to use whatever garments are necessary.

The inserts are designed to be interchangeable between corresponding body areas of the various garment modules. For example, the back insert will fit in the vest, in all the shirts, in the short and long johns, in the spring suit, and in the full suit.

A single outer shell can be used to support a plurality of pockets and inserts. The outer shell can have a patterned design. The garment can be turned inside out to facilitate placing an insert into or removing it from its pocket However, after the inserts have been adjusted, the garment is reversed again to return the garment to its normal orientation.

Still other objects of the present invention will become readily apparent to those skilled in this art from the following description, wherein there are shown and described preferred embodiments of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF PREFERRED EMBODIMENTS

Figure 1:
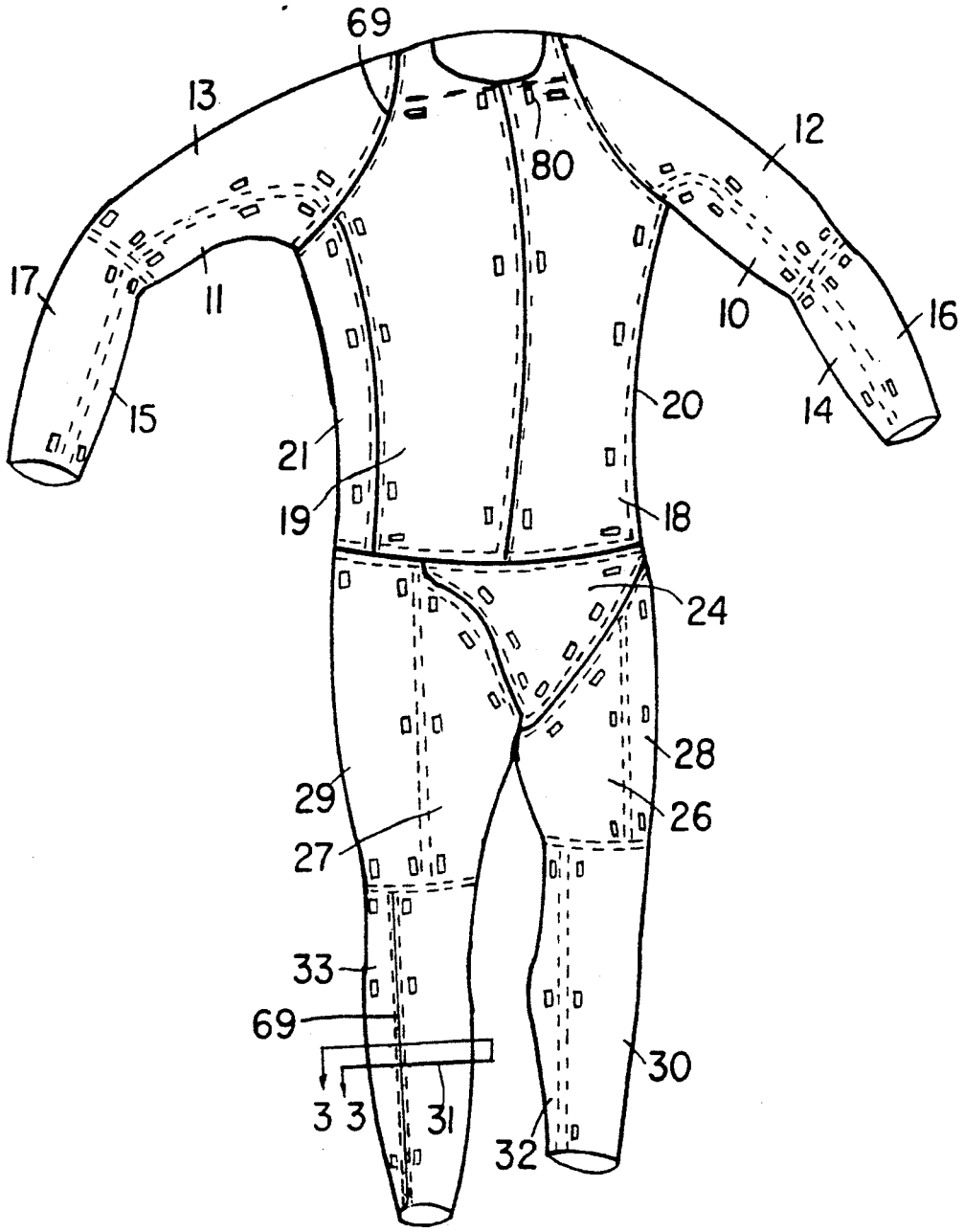
FIG. 1 is a front view of a full suit of the invention.
Figure 2:
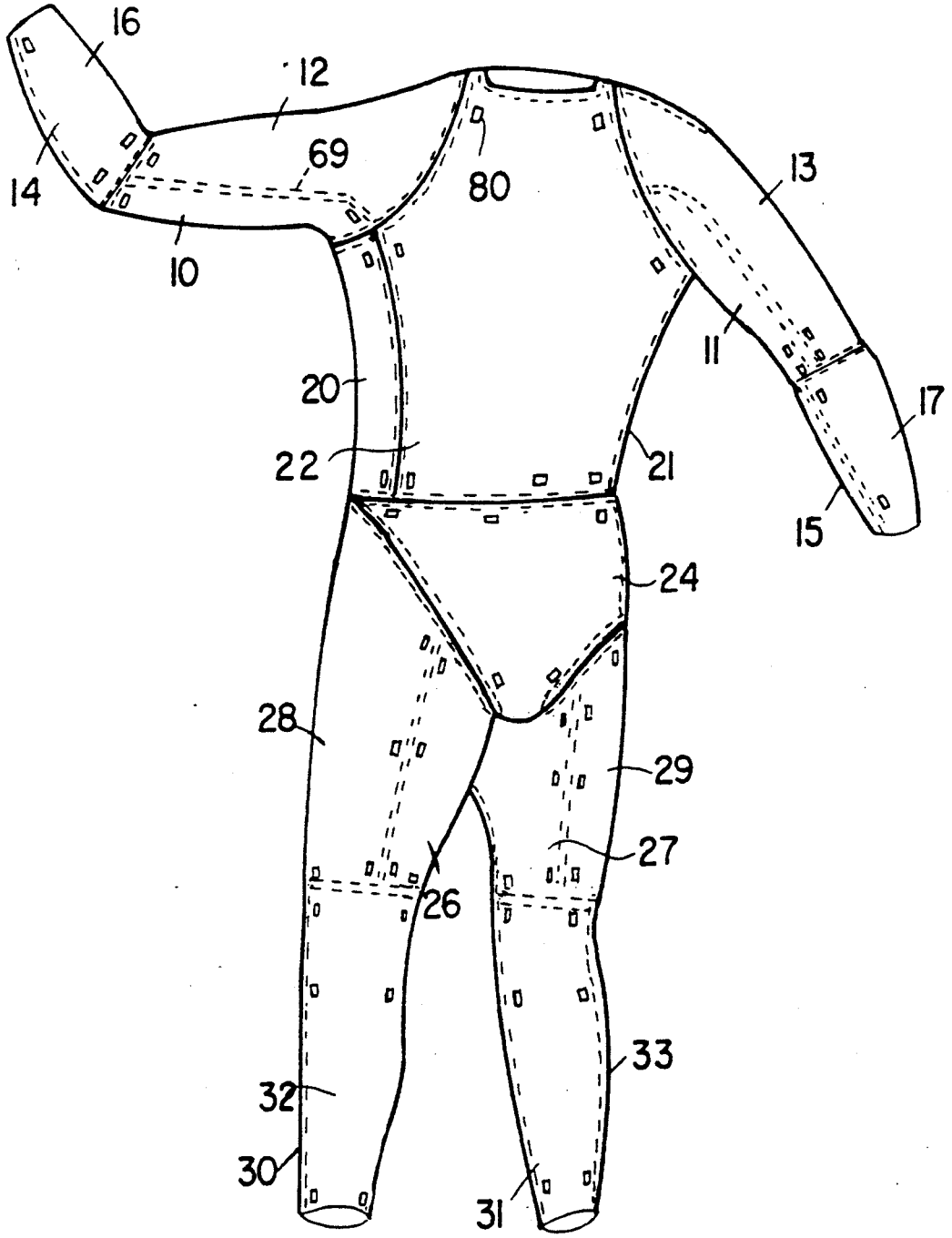
FIG. 2 is a rear view of a full suit of the invention.

With reference to FIGS. 1 and 2, the following Table lists the garment panels that are placed in and removed from the garment modules which make up a full suit 5 of the invention.

Table of Panel Inserts Which Fit Into the Garment Modules

| Name of panel | Reference number |
|---|---|
| left inner upper arm | 10 |
| right inner upper arm | 11 |
| left outer upper arm | 12 |
| right outer upper arm | 13 |
| left inner forearm | 14 |
| right inner forearm | 15 |
| left outer forearm | 16 |
| right outer forearm | 17 |
| left front chest | 18 |
| right front chest | 19 |
| left side chest | 20 |
| right side chest | 21 |
| rear back | 22 |
| crotch | 24 |
| left inner thigh | 26 |
| right inner thigh | 27 |
| left outer thigh | 28 |
| right outer thigh | 29 |
| left front calf | 30 |
| right front calf | 31 |
| left rear calf | 32 |
| right rear calf | 33 |

In FIGS. 1–2, the outer edges of the respective panels are shown by a dotted line. Loop means for attaching the inside surface of the continuous outer shell of the garment of the invention to the respective panel inserts, which have complementary barb means, are shown as circles 80 (also see FIG. 3 and the description for FIG. 3 hereinbelow).

More specifically, for the full suit shown in FIGS. 1 and 2, the garment module containing left inner forearm panel 14 is adjacent to the garment module containing left outer forearm panel 16. The garment module containing left inner forearm panel 14 is also adjacent to the garment module containing left inner upper arm panel 10. The garment module containing left outer forearm panel 16 is also adjacent to the garment module containing left outer upper arm panel 12. The garment module containing left inner upper arm panel 10 is also adjacent to the garment module containing left side chest panel 20. The garment module containing left outer upper arm panel 12 is also adjacent to the garment modules containing the left front chest panel 18 and the rear chest panel 22. The garment module containing left front chest panel 18 is also adjacent to the respective garment modules containing left side chest panel panel 20, right front chest panel 19, and crotch panel 24. The garment module containing right front chest panel 19 is also adjacent to the respective garment modules containing right side chest panel 21, right outer upper arm panel 13, crotch panel 24, and right outer thigh panel 29.

A zipper 5 is shown between the garment module containing the respective left front chest panel 18 and right front chest panel 19.

The garment module containing right outer upper arm panel 13 is also adjacent to the respective garment modules containing right inner upper arm panel 11, right outer forearm panel 17, and rear back panel 22. The garment modules containing right outer forearm panel 17 is also adjacent to the garment module containing right inner forearm panel 15. The garment module containing right inner forearm panel 15 is also adjacent to the garment module containing right inner upper arm panel 11.

The garment module containing rear back panel 22 is also adjacent to the garment module containing crotch panel 24. The garment module containing right side chest panel 21 is also adjacent to the garment module containing right outer thigh panel 29. The garment module containing right outer thigh panel 29 is adjacent to the garment module containing right inner thigh panel 27 which is also adjacent to the garment module containing crotch panel 24. The garment module containing left side chest panel 20 is also adjacent to the garment module containing left outer thigh panel 28 which is also adjacent to the respective garment modules containing crotch panel 24 and left inner thigh panel 26. The garment module containing left inner thigh panel 26 is also adjacent to the respective garment modules containing left front calf panel 32 and left rear calf panel 30. Similarly, the garment module containing left outer thigh panel 24 is also adjacent to the respective garment modules containing left front calf panel 32 and left rear calf panel 30.

The garment module containing right inner thigh panel 27 is also adjacent to the respective garment modules containing right rear calf panel 31 and right front calf panel 33. Similarly, the garment module containing right outer thigh panel 29 is also adjacent to the respective garment modules containing left front calf panel 32 and left rear calf panel 30.

All the garment modules containing the elements 1–22, 24, and 26–33 adjacent to one another as described above, form the full suit shown in FIGS. 1 and 2.

Other garments can be provided by utilizing less garment modules than those shown of the full suit in FIGS. 1 and 2. A long john is obtained by utilizing all the garment modules of FIG. 1 except the garment modules containing the eight right and left arm panels 10–17.

A short john is obtained by utilizing all the garment modules of the long john except the four calf panels 30–33.

A long sleeved spring suit is obtained by utilizing all the garment modules of the full suit in FIG. 1 except the garment modules containing the four calf panels 30–33.

A short sleeved spring shirt is obtained by utilizing all the garment modules of the long sleeved spring suit except the garment modules containing the four forearm panels 14–17.

A long sleeved shirt is obtained by utilizing all the garment modules of the long sleeved spring suit except the garment modules containing the crotch panel 24 and the thigh panels 26–29.

A short sleeved shirt is obtained by utilizing all the garment modules of the long sleeved shirt except the garment modules containing the four forearm panels 14–17.

A vest is obtained by utilizing all of the garment modules of the short sleeved shirt except the garment modules containing the upper arm panels 10–13.

The garment modules that retain the panels 10–33 discussed above are connected together by a common outer shell. The outer shell is used to support the plurality of modules, each of which contains a pocket and a replaceable insert for the pocket.

Figure 3:
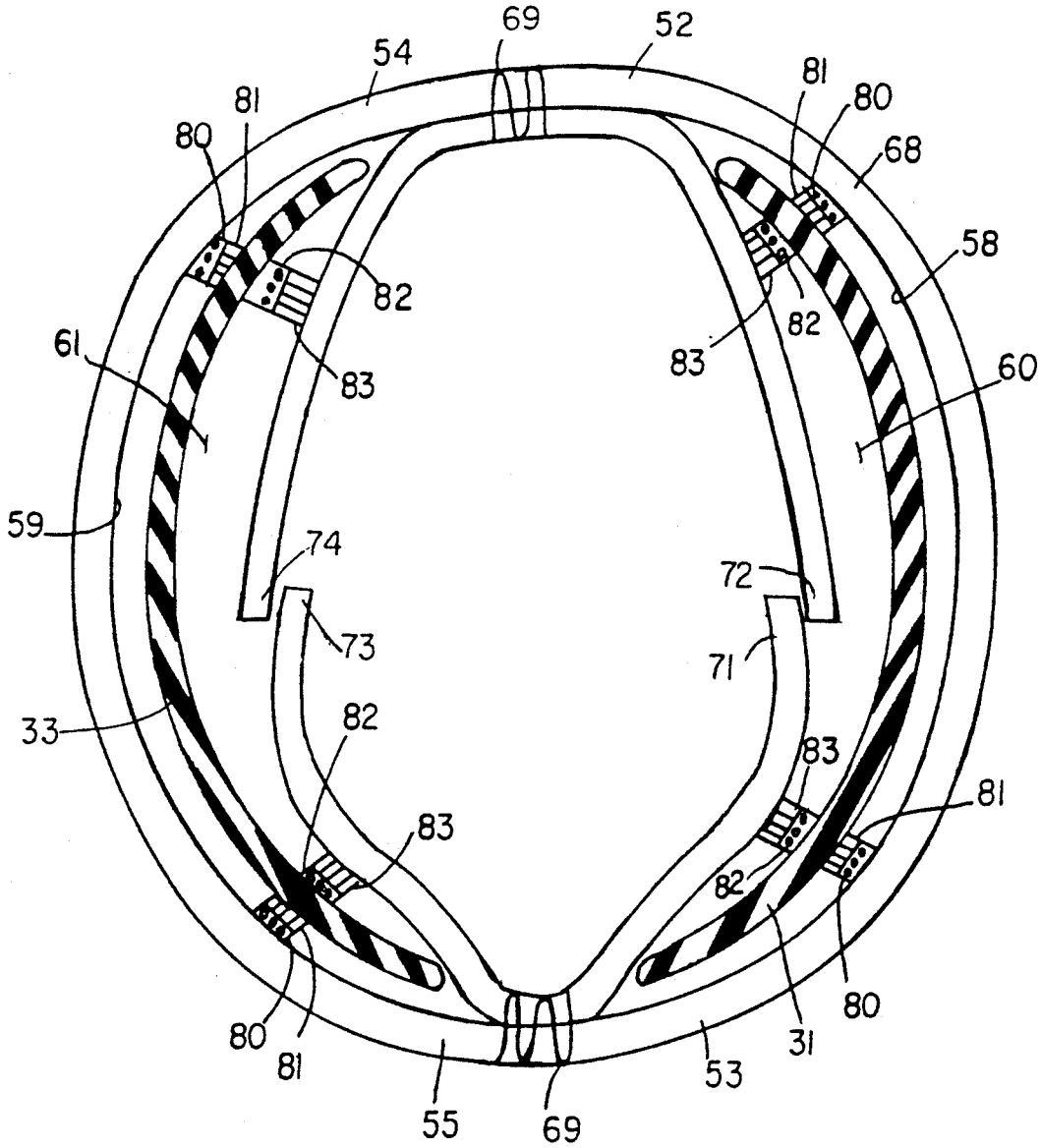
FIG. 3 is a cross-sectional view of an embodiment of the invention, for a human limb, taken along line 10—10 in FIG. 1, where a continuous outer shell is on the outside of the garment of the invention.

With respect to FIG. 3, the elements are not shown in scale, but are shown so as to make clear the relationships of the component parts. In actuality, all the elements are relatively flat individually and form a relatively flat cross section in combination.

As shown in the enlarged cross-sectional view in FIG. 3, right rear calf panel 31 and right front calf panel 33 are contained in respective garment modules 58 and 59 which share a common outer shell 68. The outer shell 68 can be made from an elastic or inelastic waterproof or water resistant, non-airtight material. Respective panels 31 and 33 are made from flexible, water-repellent material such as a neoprene rubber. The pocket 60 for garment module 58 is formed by a portion of the outer shell 68 and separable flaps 71 and 72. The separable flaps 71 and 72 provide a lining for the garment module 58. The pocket 61 for garment module 59 is formed by a portion of the outer shell 68 and separable flaps 73 and 74. The separable flaps 73 and 74 provide a lining for the garment module 59.

Three edges of each separable flap 71, 72, 73, and 74 are sewn onto the outer shell 68 as partially shown by stitches 69. The opposing free edges of separable flaps 71 and 72 overlap to cover the panel 31 residing in the garment module 58. The opposing free edges of separable flaps 73 and 74 overlap to cover the panel 33 residing in the garment module 59.

Complementary loops and barbs are used to fix the panel inserts inside the pockets of the garment modules. More specifically, first loops 80 are attached to the inside surface of the outer shell 68. Complementary barbs 81 are attached to the respective panel inserts 31 and 33. Interengagement of complementary first loops 80 and barbs 81 serves to fix the position of the panel inserts 31 and 33 on outer shell 68 inside the respective pockets 60 and 61.

Additional loops 82 are located on the panel inserts 31 and 33. These loops 82 interengage with complementary second barbs 83 that are attached to the respective separable flaps 71, 72, 73, and 74. The interengagement of loops 82 with second barbs 83 serves to provide additional means for fixing the inserts 31 and 33 within the pockets 60 and 61 of the respective garment modules 58 and 59. Moreover, the interengagement of the loops 82 and second barbs 83 serves to fix the position of the respective separable flaps 71, 72, 73, and 74 with respect to the inserts 31 and 33 and the outer shell 68.

The first loops 80 and the second barbs 83 can also serve an additional function. When panel inserts 31 and 33 are removed from the respective pockets 60 and 61 of the garment modules 58 and 59, first loops 80 and second barbs 83 undergo interengagement, whereby separable flaps 71, 72, 73, and 74 are fixed in position with respect to the outer shell 68.

The flexible, water-repellent panel inserts 31 and 33 are placed in and removed from pockets 60 and 61 by pushing aside movable pairs of opposing separable flaps 71,72 and 73,74, respectively. Once an insert 31,33 is placed in a respective pocket 60,61, normal tension on the respective flaps 71, 72, 73, and 74 keeps the pockets 60,61 closed. Alternatively, the separable edges of the flaps 71–74 can be kept closed by conventional fasteners such as complementary barb and loop fasters, snaps, zippers, and the like.

The garment can be turned inside out in order to remove and replace panel inserts. In this orientation, the separable flaps 71, 72, 73, and 74 are temporarily on the outside of the garment. After the panel inserts are adjusted, the garment can be turned inside out again so that the outer shell 68 is on the outside of the garment and the separable flaps 71, 72, 73, and 74 are on the inside of the garment.

The pockets 60 and 61 for the respective garment modules 58 and 59 and the respective water-repellent pocket insert panels 31 and 33 cover nearly the entire respective garment modules 58 and 59, leaving edge regions 52 and 53 (for panel 31) and leaving edge regions 54 and 55 (for panel 33) at which adjacent panels 31 and 33 are in close proximity to each other. Because the respective pockets 60 and 61 and the respective pocket inserts 31 and 33 extend up to the respective edge regions 52 and 53 for panel 31 and edge regions 54 and 55 for panel 33, where adjacent panels 31 and 33 are in close proximity with each other, the edge regions 52 and 55 and 53 and 54 serve, in effect, as flexible joints between adjacent pockets 58 and 59 with their respective panel inserts 31 and 33.

The pocket inserts, as stated above, are very flexible and water repellent. In this respect, the pocket inserts can be made from a variety of thin sheet materials which include a thin sheet of flexible neoprene rubber and a thin sheet of foam rubber, especially closed cell foam rubber. Because of the thinness and flexibility of the inserts 31 and 33, the use of complementary loops and barbs is preferred to fix the inserts 31 and 33 in their proper locations in the pockets.

When a garment made in accordance with the principles of the invention is worn with the outer shell on the outside of the garment, the separable flaps are not visible to an observer, and the modular nature of the garment is not readily apparent to an observer. With a continuous outer shell, the garment of the invention may give the appearance of being a substantially conventional garment and yet provide all the benefits of the invention.

Numerous benefits are obtained by employing the principles of the invention. For example, because the separable flaps and outer shell of the garment modules of the invention are made from non-airtight (and non-watertight) material, and because the neoprene inserts are not sewn together as in a conventional diving wetsuit, the suit of the invention breathes, allowing body heat to escape. In this way, with the invention, a suit to be worn on the surface of water is provided that helps prevent an undesirably excessive amount of heat build up within the suit.

In addition, a garment of the invention, has gaps between the waterproof insertable panels in adjacent garment modules. This is in contrast to a conventional wetsuit which has tightly sewn seams between waterproof wetsuit components. With the invention, the gaps between the waterproof insertable panels will allow water to drain freely out of the garment in contrast with a conventional wetsuit whose tightly sewn seams do not permit water accumulated inside the wetsuit to readily drain out of the wetsuit. A garment of the invention, by permitting water that enters the interior of the garment to drain out freely therefrom, will provide a garment to be worn on the surface of the water that is lighter in weight than a conventional wetsuit (by not having the excess weight of accumulated water), will be cooler than a conventional wetsuit (by allowing body heat to escape), and will be overall less fatiguing to wear than a conventional wetsuit which retains more dead weight from the accumulated water and more heat, both of which contribute to a wearer's fatigue.

Furthermore, since the garments of the invention do not have relatively inflexible wetsuit materials at joints of the wearer that are flexed, a suit of the invention has greater flexibility, is less movement restrictive, and is less fatiguing to wear and use on the surface of the water than a conventional wetsuit.

Furthermore, with the invention, pocket inserts can be inserted or removed from necessary body areas and can be varied in thickness to adjust to conditions that are prevalent. That is, the thickness of the inserts and the body areas protected by the pocket inserts can be changed to compensate for variations in sunshine, wind speed, temperature, and other weather factors.

The foregoing description of the invention has been presented for purposes of illustration and description. It is not intended to be exhaustive or to limit the invention to the precise form disclosed. Obvious modifications or variations of the garment system of the invention are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A garment for a wearer, comprising:

a set of a plurality of flexible, non-airtight garment modules forming a garment, wherein each of said modules includes a pocket defined by a portion of an outer shell and respective separable flaps, said separable flaps forming a lining and connected to said outer shell portion, and a plurality of flexible, water-resistant pocket inserts that are capable of being placed in and removed from said pockets by separating said flaps.

2. The garment described in claim 1 wherein a garment module and a respective pocket are substantially coextensive.

3. The garment described in claim 1 wherein said separable flaps of said lining are in the form of pairs of opposing flaps.

4. The garment described in claim 1 wherein said pockets and said pocket inserts extend substantially up to an edge of a garment module, and said pocket inserts are interchangeable between corresponding body parts in various sets of garment modules.

5. The garment described in claim 1 wherein said garment is worn by a wearer for use in an activity on the surface of water.

6. The garment described in claim 1 wherein said garment modules are made from an elastic material.

7. The garment described in claim 1 wherein the outer shell is continuous and supports a plurality of the garment modules.

8. The garment described in claim 1 wherein said garment modules include separable flaps that contact the wearer.

9. A garment, comprising:

an outer shell, a plurality of pairs of opposing separable flaps, forming a lining, attached to said outer shell, such that a set of a plurality of flexible, non-airtight, elastic garment modules are formed, said modules including pockets formed by said outer shell and said pairs of opposing separable flaps, a plurality of flexible, water-resistant pocket inserts, and first releasable means for connecting said outer shell to said pocket inserts within said pockets.

10. The garment described in claim 9, further including second releasable means for connecting said separable flaps to said pocket inserts within said pockets.

11. The garment described in claim 10 wherein, when said pocket inserts are removed, said first releasable means and said second releasable means are in engagement to fix said separable flaps to said outer shell.

* * * * *